US005299995A

United States Patent [19]

Ko

[11] Patent Number: 5,299,995

[45] Date of Patent: Apr. 5, 1994

[54] FOOT EXERCISING APPARATUS

[75] Inventor: Ching-Ho Ko, Chang Hua Hsien, Taiwan

[73] Assignee: Yow Li Feng Industrial Co. Ltd., Chang Hua Hsien, Taiwan

[21] Appl. No.: 58,352

[22] Filed: May 10, 1993

[51] Int. Cl.[5] ..... A63B 22/04; A63B 69/16

[52] U.S. Cl. ..... 482/52; 482/60

[58] Field of Search ..... 482/51, 52, 53, 70, 482/60, 61, 121, 122, 131, 114

[56] References Cited

U.S. PATENT DOCUMENTS 4,946,162 8/1990 Lubie ..... 482/51

4,958,830 9/1990 Huggins et al. ..... 482/51

5,180,351 1/1993 Ehrenfried ..... 482/51

FOREIGN PATENT DOCUMENTS 2012599 8/1979 United Kingdom ..... 482/52

*Primary Examiner*—Stephen R. Crow

*Attorney, Agent, or Firm*—Morton J. Rosenberg; David I. Klein

[57] ABSTRACT

A foot exercising apparatus including a main support adjustably mounted on a base plate in a sloping position, two linked sliding blocks driven by pedals with the legs to slide alternatively up and down in two tracks on two opposite long sides of the main support.

8 Claims, 4 Drawing Sheets

FOOT EXERCISING APPARATUS

BACKGROUND OF THE INVENTION

The present invention relates to exercising apparatus, and more particularly to a foot exercising apparatus for exercising the legs which can be adjusted according to the user's posture.

Various exercising apparatus are known, and widely used for exercising the legs. These foot exercising apparatus include standing bicycles, step machines, etc. These foot exercising apparatus are commonly heavy, and they need much installation space. Further, these foot exercising apparatus do not allow people to exercise the legs while sitting on an office chair. Therefore, one must leave from the table when wishes to exercise the legs.

SUMMARY OF THE INVENTION

The principal object of the present invention is to provide a foot exercising apparatus which allows the user to exercise the legs during a working interval while sitting on a chair. It is another object of the present invention to provide a foot exercising apparatus which can be conveniently adjusted for reciprocating the legs according to the sitting position of the user.

According to the preferred embodiment of the present invention, the foot exercising apparatus comprises a base plate having two spaced upright pivot holders at the top, a main support pivotably connected to the pivot holders by a pivot pin and adjustably supported in a sloping position above the base plate by a locating rod, the main support having two sliding tracks on two opposite long sides thereof and a big pulley at the top and two small pulleys at the bottom, a damping device fastened to the main support to give a damping force to the big pulley, two sliding blocks guided by a respective roller to slide in either track, the sliding blocks being linked by a steel rope at the top and an elastic wire at the bottom, the steel rope passing over the big pulley, the elastic wire passing over the small pulleys, and two pedals respectively fastened to the sliding blocks at an outer side by spindles for moving the sliding blocks in the tracks with the legs up and down alternatively.

DETAILED DESCRIPTION OF THE PREFERRED EMBODIMENT

Figure 1:
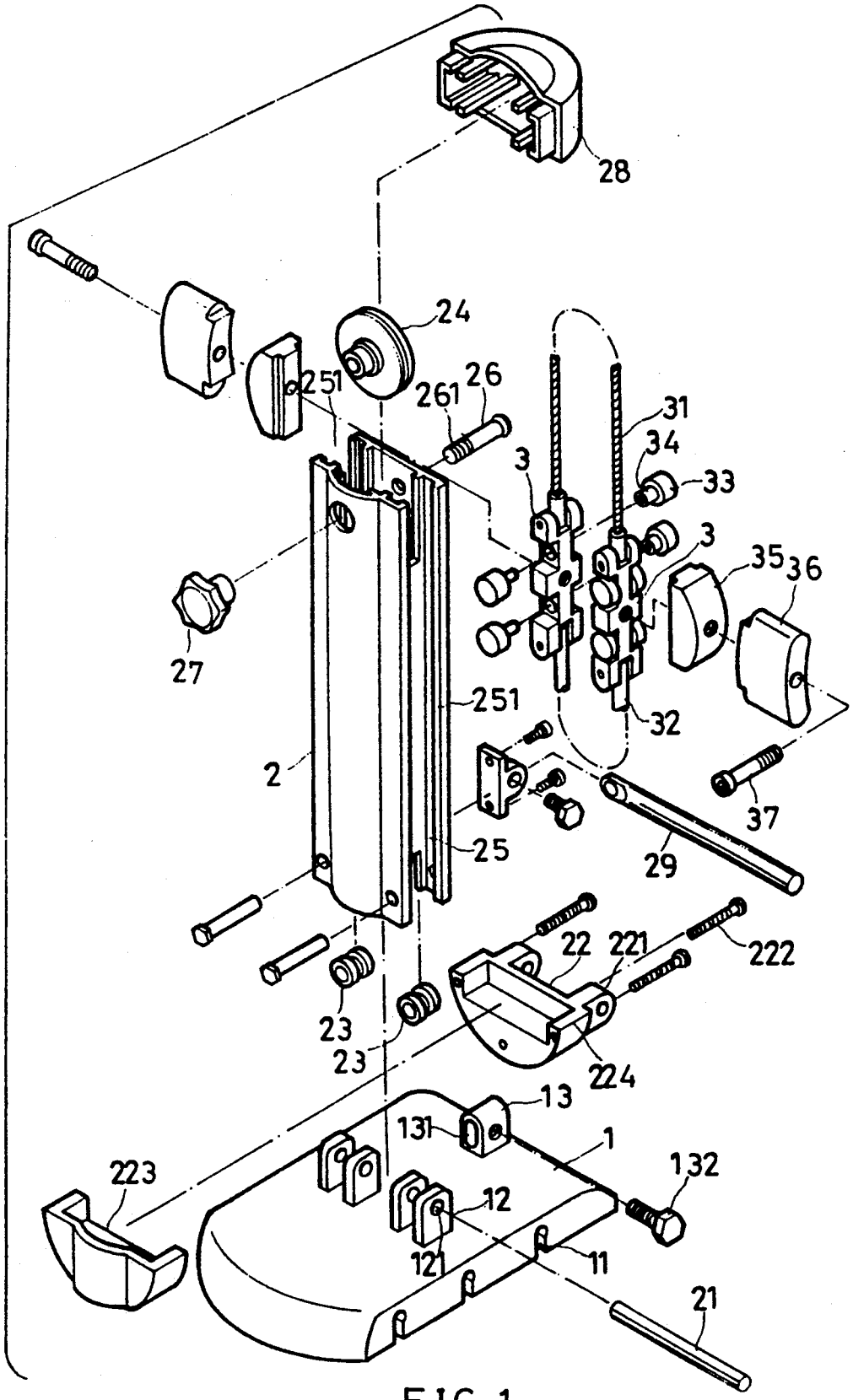
FIG. 1 is a perspective exploded view of a foot exercising apparatus according to the preferred embodiment of the present invention.
Figure 2:
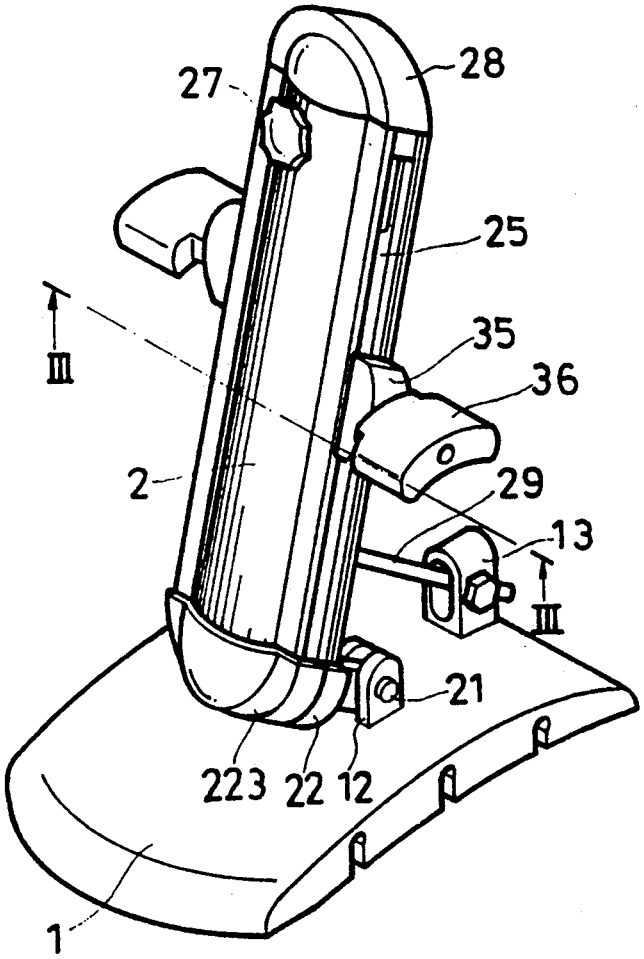
FIG. 2 is a perspective assembly view of the foot exercising apparatus.
Figure 3:
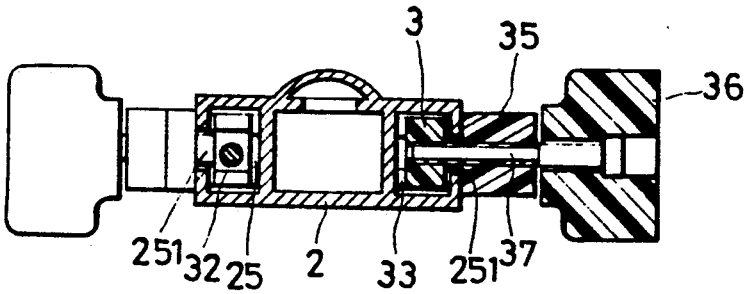
FIG. 3 is a cross sectional view taken along line III—III of FIG. 2.
Figure 4:
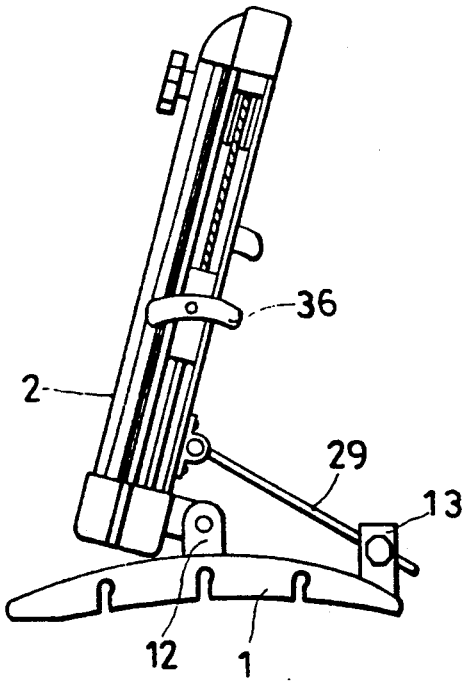
FIG. 4 is a side view of the foot exercising apparatus.

Referring to FIGS. 1, 2, 3 and 4, a flat base plate 1 is made from plastics through an injection molding process. The base plate 1 has grooves 11 through the bottom edge thereof for inserting a steel rope, which can be pulled with the hands at two opposite ends thereof (a conventional exercising method). Two upright pivot holders 12 are raised from the base plate 1 in the middle with respective axle holes 121 aligned. A locating block 13 made on the base plate 1 near one side and equally spaced from the pivot holders 12. The locating block has a locating hole 131 perpendicular to the axis through the axle holes 121, and a tightening up screw 132 perpendicularly threaded through one side wall thereof into the locating hole 131. A pivot pin 21 is inserted through the axle holes 121 to hold a main support 2 for allowing the main support 2 to be pivoted thereon. A locating rod 29 is provided to support the main support 2 on the base plate 1 at a sloping position. The locating rod 29 has one end pivotably connected to the main support 2 at a suitable location and an opposite end inserted into the locating hole 131 on the locating block 13 and fixed by the tightening up screw 132. By means of the control of the tightening up screw 132 and the locating rod 29, the amount of deviation of the position of the main support 2 from the vertical is adjusted. The main support 2 is made from aluminum through an extruding process. A connecting member 22 is fastened to the main support 2 at the bottom. The connecting member 22 has two spaced mounting lugs 221 respectively connected to the pivot holders 12 by the pivot pin 21. A bottom end cap 223 is fastened to the connecting member 22 by screws 222 and attached to main support 2 at the bottom. The connecting member 22 and the bottom end cap 223 form into a chuck to hold the bottom end of the main support 2 tightly. Two spaced bottom pulleys 23 are fastened to the main support 2 at the bottom. The free end, namely, the top end of the main support 2 is mounted with a top pulley 24. The outer diameter of the top pulley 24 is equal to the maximum length between the two bottom pulleys 23. Two parallel tracks 25 are bilaterally made on the main support 2 through the length. Two openings 251 are made on two opposite ends of the main support 2 and respectively disposed in communication with the parallel tracks 25. The periphery of either bottom pulley 23 touches either track 25. The periphery of the top pulley 24 touches the tracks 25. The tracks 25 are blocked at the bottom by a stop wall 224 of the connecting member 2. A damping device 27 is attached to the main support 2 and fastened to the outer thread 261 of a wheel axle 26 on which the pulley 24 is mounted. The damping force is regulated by turning the wheel axle 26 in either direction. A top end cap 28 is fastened to the main support 2 at the top and covered over the pulley 24. Two sliding blocks 3 are joined by a steel rope 31, which passes over the pulley 24, and an elastic wire 32, which passes over the rollers 23, and disposed in the tracks 25 respectively. The elastic wire 32 has a weak tensile elasticity, and is provided to facilitate the installation. The sliding block 3 is fastened with a respective roller 33 by an axle 34. The outer diameter of the roller 33 is relatively longer than the width of the sliding block 3. The axle 34 of the roller 33 on either sliding block 3 is perpendicularly disposed between two opposite side walls of the respective track 25. Therefore, the roller 33 touches the surface of the respective track 25 to guide the sliding of the sliding block 3 in the respective track 25. The sliding block 3 has an outer side fastened with a block pedal 36 by a spindle 37 and a cushion 35.

Figure 5:
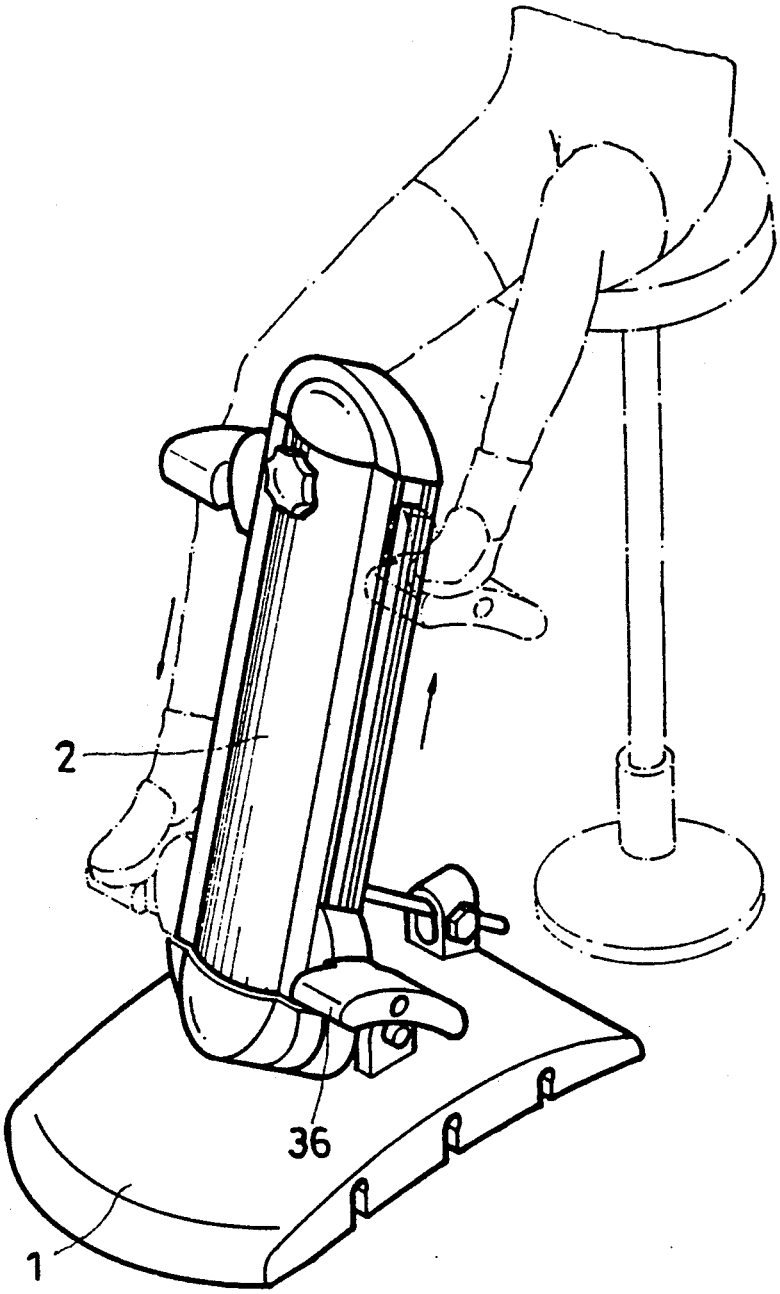
FIG. 5 is an applied view showing the foot plates alternatively reciprocated.

When in use, as shown in FIG. 5, the main support 2 is adjusted to the desired sloping position above the base plate 1, then the user is sit on a chair by the apparatus with the legs placed on the two pedals 36 of the two sliding blocks 3, and then the two pedals 36 of the two sliding blocks 3 are alternatively stepped up and down with the legs. Because the two sliding blocks 3 are linked by the steel rope 31 at the top and the elastic wire 32 at the bottom, moving one sliding block 3 (pedal 36) downwards causes the other sliding block 3 (pedal 36) to be relatively lifted up.

While only one embodiment of the present invention has been shown and described, it will be understood that various modifications and changes could be made without departing from the spirit and scope of the invention.

What is claimed is:

1. A foot exercising apparatus comprising:

a base plate having at least one upright pivot holder at the top;

a main support pivotably connected to said at least one pivot holder by a pivot pin and disposed in a sloping position above said base plate, said main support comprising two sliding tracks on two opposite sides thereof through the length of said main support, a top opening and a bottom opening disposed on two opposite ends thereof and communicated with said sliding tracks respectively, at least one top pulley respectively fastened in said top opening, at least one bottom pulley respectively fastened in said bottom opening, a stop wall abutting said tracks at their bottoms, a damping device for providing a damping force to said top pulley;

two sliding blocks respectively fastened with a respective roller by a respective axle and guided by the respective roller to slide in said sliding tracks, each sliding block having a top end linked to each other by a steel rope and a bottom end linked to each other by an elastic linkage, said steel rope passing over each of said at least one top pulley, said elastic linkage passing over each of said bottom pulley; and two pedals respectively fastened to said sliding blocks at an outer side by spindles for moving said sliding blocks in said tracks wherein the user's legs move down alternatively.

2. The foot exercising apparatus according to claim 1 wherein said base plate has two upright pivot holders, said upright pivot holders having axle holes respectively aligned with said pivot pin for rotation thereof.

3. The foot exercising apparatus according to claim 1 wherein said main support comprises two small bottom pulleys spaced in said bottom opening, and one big top pulley suspended in said top opening.

4. The foot exercising apparatus according to claim 1 wherein the axle of the roller on either sliding block is perpendicularly disposed between two opposite side walls of the respective sliding track.

5. The foot exercising apparatus according to claim 1 wherein said main support has one end fastened with a connecting member and a bottom end cap, said connecting member comprising spaced lugs respectively and pivotably mounted on said pivot pin and a flange formed into said stop wall.

6. The foot exercising apparatus according to claim 1 wherein said main support is supported in said sloping position by a locating rod, said locating rod having one end pivotably connected to said main support above said connecting member and an opposite end inserted through a hole on a locating block on said base plate and held down by a screw.

7. The foot exercising apparatus according to claim 1 wherein the diameter of said big top pulley is equal to the maximum distance between said two small bottom pulleys.

8. The foot exercising apparatus according to claim 1 wherein a cushion is disposed between either sliding block and the respective pedal.

* * * * *